US005429081A

United States Patent [19]

Fransson et al.

[11] Patent Number: 5,429,081

[45] Date of Patent: Jul. 4, 1995

[54] LUBRICATING OIL FEED DEVICE IN AN INTERNAL COMBUSTION ENGINE

[75] Inventors: Håkan Fransson, Björnlunda; Peter Örning, Tumba, both of Sweden

[73] Assignee: Saab-Scania Aktiebolag, Sodertalje, Sweden

[21] Appl. No.: 185,469

[22] Filed: Jan. 24, 1994

[30] Foreign Application Priority Data

Feb. 1, 1993 [SE] Sweden ..... 9300307

[51] Int. Cl.[6] ..... F01M 11/02

[52] U.S. Cl. ..... 123/196 R; 123/195 A

[58] Field of Search ..... 123/196 R, 195 A, 195 C

[56] References Cited

U.S. PATENT DOCUMENTS

| | | | |
|---|---|---|---|
| 4,508,072 | 4/1985 | Takami et al. | 123/195 A |
| 4,523,553 | 6/1985 | Backlund | 123/195 A |
| 5,065,713 | 11/1991 | Seats | 123/195 A |
| 5,152,264 | 10/1992 | Evans | 123/196 R |
| 5,245,960 | 9/1993 | Macier et al. | 123/195 A |

FOREIGN PATENT DOCUMENTS

| | | | |
|---|---|---|---|
| 2854992 | 7/1980 | Germany | 123/195 A |
| 4211896 | 10/1993 | Germany | 123/195 C |

*Primary Examiner*—Henry C. Yuen
*Assistant Examiner*—Erick Solis
*Attorney, Agent, or Firm*—Ostrolenk, Faber, Gerb & Soffen

[57] ABSTRACT

Device for feeding oil from the lubricating oil system of an internal combustion engine to units mountable on a unit support plate which is secured to the engine block. On one surface of the unit support plate facing out from the engine block there are one or more oil distribution ducts incorporated in the support plate, each of which connects to the lubricating oil system of the engine at the block to at least one associated mounted unit. Each duct is defined by a groove in the support plate surface outward from the engine block. Each groove is covered on the surface of the support plate by a cover plate secured in the unit support plate. Each duct groove has its associated cover plate preferably secured in the unit support plate by shape and/or friction.

20 Claims, 2 Drawing Sheets

LUBRICATING OIL FEED DEVICE IN AN INTERNAL COMBUSTION ENGINE

BACKGROUND OF THE INVENTION

The present invention relates to a lubrication oil feed device for an internal combustion engine and particularly to the ducts for feeding oil from a supply to units supported on the engine block.

In motor vehicles, particularly heavier vehicles such as trucks and buses, there is an increasing need to provide or coordinate the vehicle engine with additional units of different types. In this case, the additional units may belong to the engine, such as an injection pump or a turbocompressor unit, or they may be units driven by the engine, for example an air compressor in a compressed air system for brake operation, or they may be other equipment which interacts with the engine.

In the case of heavier trucks and buses in particular, the vehicle engine is often a diesel engine which operates on the basis of supercharging generated by means of a turbocompressor. Lock free braking systems are frequently also used in such vehicles, wherein the brakes are operated by a compressed air system. A common feature of these types of vehicles and engines is the need to be able to fit the equipment concerned and the units required for it on or close to the vehicle engine for drive and functional reasons. In a number of cases, the equipment and units also must be fitted with efficient lubricating oil systems. It is appropriate for these lubricating oil systems to be coordinated with the engine lubricating system. In practice, this is achieved by incorporating the lubricating system of the equipment-/units respectively in the engine lubricating oil system.

According to the prior art, equipment/units of the type discussed above are mounted on a common supporting part which is securely fitted to the vehicle engine. The type of supporting part may, for example, be a supporting plate which is normally secured to the short side of the engine block adjacent to the clutch which is normally integral with the engine. This type of supporting plate is normally called a transmission plate. Lubricating oil is then normally fed to/from the equipment or units mounted on the transmission plate via external hoses or pipes which connect lubricating oil ducts of the equipment/units to lubricating oil ducts in the engine block. In this case, the connections between the ends of the hoses/pipes and equipment/units and the engine block respectively are normally made by means of nipples.

In order to avoid the need for such external hoses/-pipes between the units/equipment and engine block altogether, or at least to minimize this requirement, solutions have also been developed where the external hose and pipe connections have been replaced by die cast or drilled ducts inside the transmission plate itself. This obviates the need for such hoses and pipes. But, the transmission plate must, on the other hand, be designed as a cast cover which, because of the space required for its internal ducts, must of necessity have a much greater thickness than a conventional transmission plate without internal ducts.

The disadvantages of such a cast cover provided with internal oil ducts are, among other things, that it has a large design thickness, it is expensive to manufacture, and it is very heavy.

SUMMARY OF THE INVENTION

The object of the invention is to avoid the disadvantages inherent in the above mentioned cast cap-shaped transmission plates, yet still enable the oil to be fed between units to be supplied with oil and the engine block via internal ducts in the transmission plate. The transmission plate should therefore be relatively thin, inexpensive to manufacture and should have relatively low weight, while obviating the need for external connecting hoses or pipes, with the attendant risk of damage.

The above object is achieved according to the invention which concerns a device for feeding oil from the lubricating oil system of an internal combustion engine to units mountable on a unit support plate which is secured to the engine block. On one surface of the unit support plate facing out from the engine block, there are one or more oil distribution ducts incorporated in the support plate. Each duct connects the lubricating oil system of the engine at the block to at least one associated supported unit. Each duct is defined by a groove in the support plate surface facing outward from the engine block. Each duct is covered on the outward surface of the support plate by a cover plate which is secured in the unit support plate. Each duct groove has its associated cover plate preferably secured in the unit support plate by shape and/or friction.

The invention is based on the principle that the plate supporting the units incorporates one or more internal oil distribution ducts. Each duct comprises a groove made in the surface of the plate supporting the units by cutting, machining or cold forming in the plate. The groove in the surface of the plate, and particularly in the surface that faces outward from the engine block, is covered by a cover plate which is secured to the supporting plate. Every such oil distribution duct is connected to the lubricating oil duct in the engine block and to at least one of the units concerned.

According to a preferred embodiment each oil distribution duct is essentially straight and continuous and is connected at one end to the lubricating oil system of the engine and at the other end to one of the units.

The oil distribution ducts comprise a plurality of grooves of the same width which are milled into the supporting plate for the units and which are covered with individual cover plates. Each cover plate is preferably incorporated in the supporting plate by shape locking and/or friction or by .other suitable method, e.g. welding. This fastening arrangement may, for example, be achieved by securing the cover plate in a dovetail groove overlapping the distribution duct and extending along the entire length of the duct groove, the dovetail groove having a cross-section exceeding the width of the duct groove. To achieve such fastening in such a dovetail groove, the cover plate should suitably exhibit a somewhat arch shaped cross-sectional profile before being fastened, so that the cover plate can be fastened by being upset along its center line causing the cover plate edges to be consequently pressed outward to engage lock tight with the respective undercut edges of the dovetail groove.

The lubricating oil connection between the respective oil distribution ducts and the lubricating oil duct of the engine block on the one hand, and the associated supported units on the other hand, may quite simply comprise through holes at the respective ends of the distribution ducts. These holes then extend between the bottom of the duct and the surface of the unit supporting plate which is opposite the cover plate supporting side.

With an oil feed device according to the invention, the lubricating oil is fed via internal oil distribution ducts inside the unit supporting plate. This completely eliminates the need for external hoses or pipes between the engine block and the respective additional units, which provides a much simpler solution from the design point of view, where the thickness of the unit supporting plate may be much less than the thickness achieved with a cast transmission cover.

The invention is explained below with reference to embodiments and design details shown in the attached drawings.

DESCRIPTION OF A PREFERRED EMBODIMENT

Figure 1:
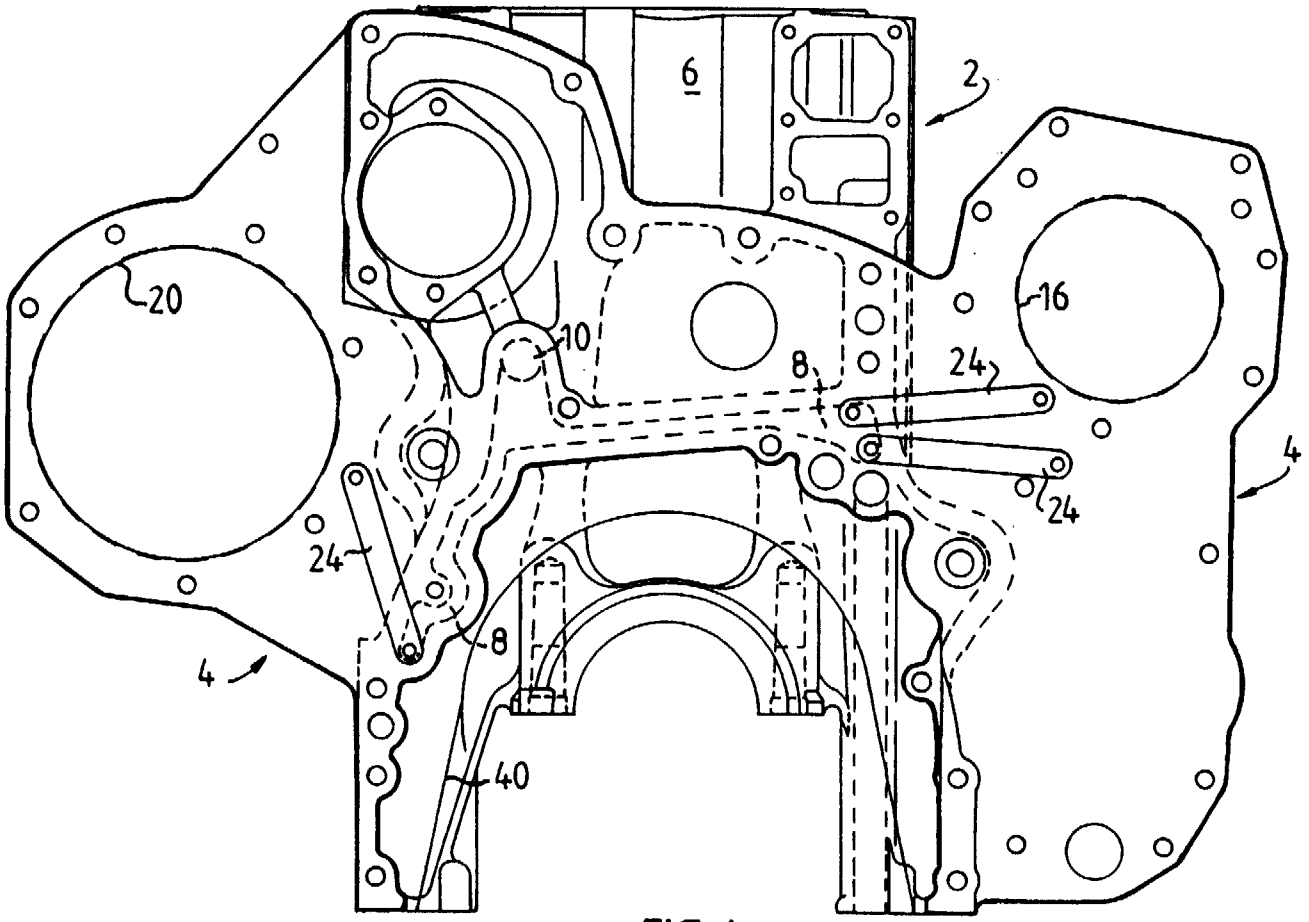
FIG. 1 shows an end view of a longitudinally mounted vehicle engine which is fitted on its rear end side with a unit supporting plate according to the invention which is secured to the engine block.

The vehicle engine indicated in FIG. 1 is shown for the sake of simplicity merely in the form of an engine block 2, and particularly the engine block for a longitudinally mounted diesel engine for a truck whose brakes are operated with a compressed air system.

A unit supporting plate 4 is secured by means of screws (not shown) to the rear end side of engine block 2, shown in FIG. 1. On the front side of the plate 4, which is not shown in FIG. 1, different units may be mounted which, for operation, should be fed with lubricating oil from the same lubricating oil system which provides the lubrication of the internal combustion engine, and which is therefore incorporated in the engine block 2.

The invention relates to a device with which oil from the lubricating oil system of the engine can be fed to units mounted on the unit supporting plate 4 that is secured to and sealed against engine block 2. The unit supporting plate 4 is secured to the rear end face or side 6 of engine block 2, shown in FIG. 1. That end face is designed such that plate 4 covers a surface area of engine block 2 which includes at least one engine block duct 8 that is connected to the lubricating oil system in the engine block 2. The duct 8 opens out toward the adjacent unit supporting plate 4. In the embodiment shown, the duct 8 is connected to the lubricating oil system of the engine by an oil inlet port 10.

Figure 4:
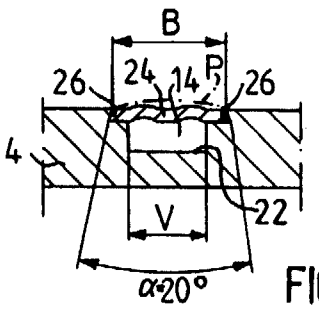
FIG. 4 shows on an even larger scale a cross-section along line IV—IV in FIG. 2.
Figure 2:
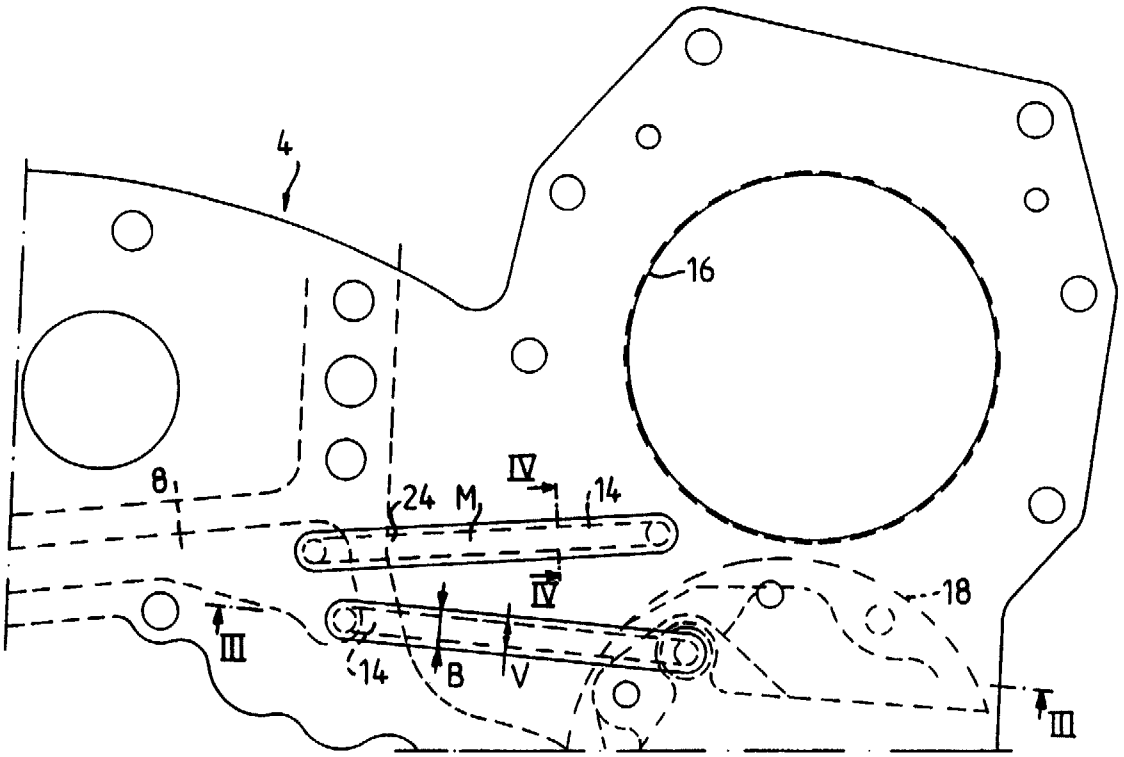
FIG. 2 shows on a larger scale a partial area of the unit supporting plate according to FIG. 1.
Figure 3:
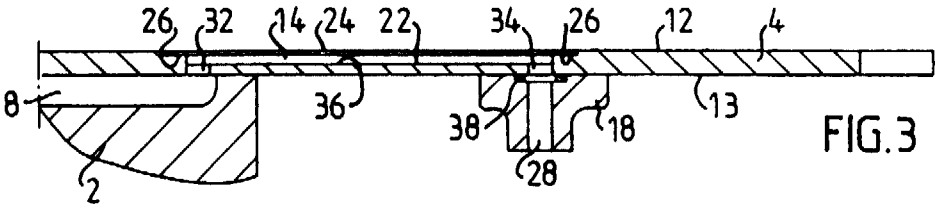
FIG. 3 shows a cross-section along line III—III in FIG. 2.

On the side or surface of unit supporting plate 4 which faces away from engine block 2, three oil distribution ducts 14 are cut into the plate 4, from its side 12, as shown in particular in FIGS. 2–4. Each such duct 14 is connected at one end, in terms of flow, to engine block duct 8 and at its other end is connectable to the respective associated unit (not shown) supported by and mounted on the unit supporting plate 4. FIG. 1 shows the mounting positions for two of the units in the form of circular openings 16, 20. The unit at opening 16 may, for example, be a flange mounted air compressor for the compressed air system of the vehicle brakes. The unit mounted at opening 20 may, for example, be the flange mounted injection pump of the engine. The third unit shown in FIG. 2 may be a turbocompound unit, e.g. of the type marketed by Scania.

As shown in FIGS. 3 and 4, each distribution duct 14 comprises a groove 22 made preferably by cutting or machining in surface 12 of the unit supporting plate 4. In practice, the simplest method of producing grooves 22 should be by milling them. Each groove is covered by a respective cover plate 24 which is secured in plate 4 at a height level with the surface 12. The plate 24 closes the groove 22 to define the duct.

Grooves 22 of the distribution ducts 14 are preferably of rectangular cross-section (see FIG. 4) and suitably have their associated cover plates 24 incorporated in unit supporting plate 4 by the shape of the plate and/or by friction with the plate. As shown in FIGS. 3 and 4, each cover plate 24 is incorporated in the unit supporting plate 4 in a dovetail groove 26 which overlaps the associated distribution duct 14, with edge sides undercut inside the plate 4. The groove 26 extends along the entire length of duct groove 22 and exhibits a cross-section B, which exceeds width V of duct groove 22. The edge sides of dovetail groove 26 may be undercut at an angle of the order of 10°, giving a total dovetail groove angle $\alpha$ of the order of 20°.

Cover plate 24 secured in dovetail groove 26 exhibits a somewhat arch shaped cross-sectional profile P before fastening, as shown in FIG. 4 (much exaggerated), in the form of a dot-dash contour. Because of this arch shaped cross-sectional profile P, cover plate 24 can be secured in dovetail groove 26 by upsetting (pressing in) the plate along its center line M, so that the edges of the arched cover plate are pressed outward and are caused to engage lock tight and sealed with the undercut edge side surfaces of dovetail groove 26.

As shown in FIG. 3, oil distribution duct 14 is connected to engine block duct 8 and to an oil duct 28 in its associated unit 18 via a first and second connection 32, 34 respectively, here in the form of a pair of holes 32 and 34 passing through the unit supporting plate at the ends of bottom 36 of duct 14. A sealing ring 38 is provided at the opening into duct 28 in unit 18.

In the embodiment shown in FIG. 1, unit supporting plate 4 is shown as being secured to engine block 10 at the end of the engine adjacent to a clutch (not shown) connected to the engine. This clutch projects from the engine block through opening 40, which is shaped as an upside down U, on the lower section of end side 6 of engine block 2. Unit supporting plate 4 may therefore be suitably called a transmission plate in this case because it is located at the transmission end of the engine. As shown in FIG. 1, transmission plate 4 projects at right angles to the longitudinal axis of the engine on both sides of the engine, and supports on each side at least one unit, as indicated by openings 16, 20.

The embodiment described above will not restrict the scope of the invention, which may also take the form of other embodiments. For example, each distribution duct can be provided with connections to several units. Moreover, the appearance of the ducts may be varied without departing from the general concept of the invention.

Although the embodiment described above and shown in the drawing is conceived principally to represent the invention where applied to the engine of a truck with injection pump, air compressor and turbocompound unit, the invention may equally be applied, of course, to passenger cars or other vehicles where there is a requirement for mounting some kind of unit on the vehicle engine. Further, the invention is not merely restricted in use to vehicles. It may also be used in other engine applications.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for feeding oil to at least one unit supported on an internal combustion engine, wherein the engine includes an engine block, a lubricating oil system of the engine located in the block, and a unit support plate for supporting at least one unit to which oil is to be distributed, the support plate having a first side surface facing the engine block and a second side surface facing away from the engine block;

the device comprising:

at least one oil distribution duct defined in and extending along the unit support plate, the duct including at least one first connection to the lubricating oil system of the engine in the block and including at least one second connection spaced from the respective first connection and located in the support plate so as to be connectable to a respective unit supported in the support plate; the duct comprising an open top groove defined in one of the surfaces of the plate;

a cover plate secured to the support plate and shaped and positioned to cover over the open top of the groove in the support plate for enclosing the groove and defining the at least one oil distribution duct.

2. The device of claim 1, wherein the engine block includes a duct connected to the lubricating oil system of the engine and extending away from the lubricating oil system, and the first connection to the groove is connected to the engine block duct.

3. The device of claim 1, wherein the cover plate is secured in the groove by respective shaping of the unit support plate at the groove and of the cover plate for holding the cover plate at the groove for defining the respective duct.

4. The device of claim 1, wherein the at least one groove is defined in the unit support plate on the second surface facing away from the engine block.

5. The device of claim 4, wherein the groove in the unit support place is essentially straight and continuous.

6. The device of claim 4, wherein the engine block includes a duct connected to the lubricating oil system of the engine and extending away from the lubricating oil system, and the first connection to the groove is connected to the engine block duct.

7. The device of claim 4, wherein the first and second connections to the groove comprise a respective through hole from the groove through the unit support plate to the second surface of the unit support plate facing toward the engine block.

8. The device of claim 1, further comprising a plurality of separate ones of oil distribution ducts formed in the unit support plate, each duct including at least one respective first connection to the lubricating oil system of the engine and at least one respective second connection located on the unit support plate at a location to be connectable to a respective unit supported on the unit support plate;

a respective one of the cover plates for each of the grooves enclosing the respective groove and thereby defining an oil distribution duct in the groove.

9. The device of claim 8, wherein each of the ducts has opposite ends, the respective first connection being at one respective end of each groove and the respective second connection being at the opposite respective end of the respective groove.

10. The device of claim 8, wherein the unit support plate is an essentially flat plate in which the ducts are provided.

11. The device of claim 8, wherein each of the grooves in the unit support plate is defined on the second surface of the plate that faces away from the engine block.

12. The device of claim 11, wherein each of the grooves is essentially straight and continuous along the plate.

13. The device of claim 8, wherein each of the oil distribution ducts is comprised of a respective one of the grooves in the unit support plate, and the grooves are generally of the same width in the unit support plate.

14. The device of claim 8, wherein the engine block has an end at which a clutch is connectable to the engine; the unit support plate being secured to the engine at that end of the engine block; the engine block having sides and the unit support plate being of a size to include portions that project past and outward from the sides of the engine block; and unit support means provided on the unit support plate at the portions of the unit support plate outward from the sides of the engine block; and the oil distribution ducts in the unit support plate extending from the area of the unit support plate over the engine block to the portions of the unit support plate outward of the engine block where the respective units to be supplied by the duct may be disposed.

15. The device of claim 8, wherein the respective cover plate is secured in each groove by respective shaping of the unit support plate at the groove and of the cover plate for holding the cover plate at the groove for defining the respective duct.

16. The device of claim 15, wherein each of the grooves is shaped so as to define a dovetail shaped groove which overlaps the associated respective distribution duct groove in the support plate and the dovetail shaped groove extending the length of the duct groove, the dovetail groove having a cross section exceeding the width of the duct groove and the cover plate being received in the dovetail groove.

17. The device of claim 16, wherein each of the grooves in the unit support plate is defined on the second surface of the plate that faces away from the engine block.

18. The device of claim 17, wherein the first and second connections to each of the grooves in the unit support plate comprises a respective through hole from the groove through the unit support plate to the first surface of the unit support plate facing toward the engine block.

19. The device of claim 16, wherein the cover plate has a somewhat arch shaped cross sectional profile before being fastened in the dovetail groove, such that the cover plate is fastened in the dovetail groove by upsetting the plate at its center across the dovetail groove, for pressing the cover plate edges outward to engage with the dovetail groove.

20. The device of claim 19, wherein the dovetail groove is defined by opposite sides of the duct groove having undercut edge side surfaces, and the upset cover plate having edges which are caused to engage lock tight with the undercut edge side surfaces of the dovetail groove for holding the cover plate to the duct groove and define the respective distribution duct.

* * * * *